US005241896A

United States Patent [19]

Braun et al.

[11] Patent Number: 5,241,896

[45] Date of Patent: Sep. 7, 1993

[54] PNEUMATIC CYLINDER APPARATUS

[75] Inventors: Phillip M. Braun, Yoder; Steven T. Miller, Fort Wayne; H. Gunnar Grotness, Fort Wayne; Robert R. Kaiser, Fort Wayne, all of Ind.

[73] Assignee: PHD, Inc., Fort Wayne, Ind.

[21] Appl. No.: 889,479

[22] Filed: May 27, 1992

[51] Int. Cl.[5] ..... F01B 29/04

[52] U.S. Cl. ..... 92/59; 92/128; 92/163; 92/164

[58] Field of Search ..... 92/163, 164, 128, 59, 92/177

[56] References Cited

U.S. PATENT DOCUMENTS

| | | | |
|---|---|---|---|
| 85,098 | 12/1868 | Inglis . | |
| 215,807 | 5/1879 | Corliss . | |
| 696,691 | 4/1902 | McCormack . | |
| 1,157,686 | 10/1915 | Fuhrman . | |
| 1,195,980 | 8/1916 | Davis . | |
| 1,625,357 | 4/1927 | Gehres . | |
| 2,040,844 | 5/1936 | Gartin | 92/164 |
| 2,173,358 | 9/1939 | Ernst . | |
| 2,212,665 | 8/1940 | Landolt . | |
| 2,598,271 | 5/1952 | Klosterman . | |
| 2,849,244 | 8/1958 | Sampson | 92/164 |
| 3,136,225 | 6/1964 | Rader . | |
| 3,272,132 | 9/1966 | Stoelting et al. | 92/164 |
| 3,511,136 | 5/1970 | Thomas et al. | 92/163 |
| 3,835,753 | 9/1974 | Bunyard . | |
| 3,961,559 | 6/1976 | Teramachi . | |
| 4,798,128 | 1/1989 | Mita | 92/59 |
| 4,899,637 | 2/1990 | Caruso | 92/164 |
| 4,973,027 | 11/1990 | Casas . | |
| 4,982,652 | 1/1991 | Blatt | 92/177 |

FOREIGN PATENT DOCUMENTS 636310 4/1950 United Kingdom .

*Primary Examiner*—Thomas E. Denion

*Attorney, Agent, or Firm*—Barnes & Thornburg

[57] ABSTRACT

A cylinder apparatus includes a piston and a cylinder tube including a first end and a second end. The cylinder tube is formed to include a central bore extending from the first end to the second end for receiving the piston therein and a second bore extending from the first end to the second end spaced apart from the central bore. The cylinder apparatus also includes a first end cap coupled to the first end of the tube and a second end cap coupled to the second end of the tube. The second end cap is formed to include a first port in communication with the central bore of the tube and a second port in communication with the second bore. First end cap and second end cap have similar configurations and use substantially identical seals. Therefore, the semi-finished parts of the present invention have substantially identical configurations, regardless of the specific embodiment selected for a particular use. Ports and fittings can be selectively added either to the semi-finished first end cap or to the semi-finished second end cap to customize each finished cylinder for use in a particular environment.

24 Claims, 4 Drawing Sheets

PNEUMATIC CYLINDER APPARATUS

BACKGROUND AND SUMMARY OF THE INVENTION

The present invention relates to a pneumatic cylinder apparatus. More particularly, the present invention relates to an improved cylinder design which increases flexibility and reduces the amount of space required for mounting or installing the cylinder.

The present invention is also designed to reduce the number of different parts required to manufacture the cylinder. The cylinder of the present invention uses symmetrical parts which can be interchanged at opposite ends of the cylinder. Therefore, parts such as tube seals and pilot rings may be used at either end of the cylinder. The cylinder of the present invention includes parts which have a similar shape regardless of the bore size of the cylinder. The parts are scaled to match the desired bore size. This common configuration between the parts simplifies automation and minimizes the requirements for manual machine set-ups.

A typical compact cylinder arrangement includes air supply fittings coupled to ports formed in opposite ends of the cylinder to move the piston back and forth within the cylinder. When the fittings and air supply tubes are added to conventional cylinders, the overall envelope size is increased in two planes. This causes problems when attempting to mount a conventional cylinder in a location where space is limited.

The cylinder of the present invention advantageously locates both control ports and both fittings at a single end of the cylinder. This permits increased flexibility for mounting the cylinder of the present invention. Therefore, the compact cylinder of the present invention can fit into smaller spaces than conventional cylinders. When both of the ports for controlling movement of the piston back and forth within the cylinder are located at a single end of the cylinder, a symmetrical tube seal of the present invention can be altered at the end of the cylinder opposite the ports to permit pneumatic communication between first and second air passages within the cylinder.

In addition, having both control ports located at a single end of a cylinder facilitates manifold mounting of a pneumatic valve. No external tubes or special adapters are required. Therefore, the cost of adding the pneumatic valve is reduced.

According to one aspect of the present invention, a cylinder apparatus includes a piston and a cylinder tube having a first end and a second end. The cylinder tube is formed to include a central bore extending from the first end to the second end for receiving the piston therein and a second bore extending from the first end to the second end spaced apart from the central bore. The cylinder apparatus also includes a first end cap coupled to the first end of the tube and a second end cap coupled to the second end of the tube. The first end cap is formed to include means for communicating air between the central bore and the second bore adjacent the first end of the cylinder tube. The second end cap is formed to include a first port in communication with the central bore of the tube and a second port in communication with the second bore.

According to another aspect of the present invention, the means for communicating air between the central bore and the second bore adjacent the first end of the cylinder tube includes a notched section formed in the first end cap to permit air flow through the notched section from the central bore to the second bore.

According to yet another aspect of the present invention, a first seal is located between the first end cap and the first end of the cylinder tube. The first seal permits air to pass between the central bore and the second bore adjacent the first end of the cylinder tube. The first end cap is formed to include a groove therein for receiving the first seal.

A second seal is located between the second end cap and the second end of the cylinder tube. The second seal blocks air flow between the central bore and the second bore of the cylinder tube adjacent the second end of the cylinder tube. The second seal includes a first section disposed adjacent the central bore, a second section coupled to the first section and disposed adjacent the second bore, and a divider located between the first section and the second section to block air flow between the first and second bores. The second end cap is formed to include a groove therein for receiving the second seal.

A notched section may be formed in the first end of the cylinder tube between the central bore and the second bore of the cylinder tube to increase the amount of air flow from the central bore to the second bore of the cylinder tube adjacent the first end of the cylinder tube. When the notched section is formed in the first end cap, first and second seals having a substantially identical shape may be used.

According to still another aspect of the present invention, the moving means comprises means for selectively coupling the first port to a pressure supply and the second port to an exhaust to move the piston in a first direction within the cylinder tube, and for selectively coupling the second port to the pressure supply and the first port to the exhaust to move the piston in a second direction within the cylinder tube.

According to a further aspect of the present invention, a piston rod is coupled to the piston. The second end cap coupled to the second end of the tube is a head cap formed to include an aperture therein configured to receive the piston rod therethrough. Means for moving the piston back and forth inside the central bore of the cylinder tube includes a first port in communication with the central bore of the tube and a second port in communication with the second bore. The first and second ports are selectively formed in one of the end cap or the head cap, depending upon the application specified by the customer. Therefore, the present invention advantageously permits both control ports to be selectively formed at either end of the cylinder. The end can be selected depending on the desired use for the cylinder.

Additional objects, advantages and novel features of the present invention will become apparent from the following detailed description of the invention when considering it in conjunction with the accompanying drawings.

BRIEF DESCRIPTION OF THE DRAWINGS

The detailed description particularly refers to the accompanying figures in which.

DETAILED DESCRIPTION OF THE DRAWINGS

Figure 1:
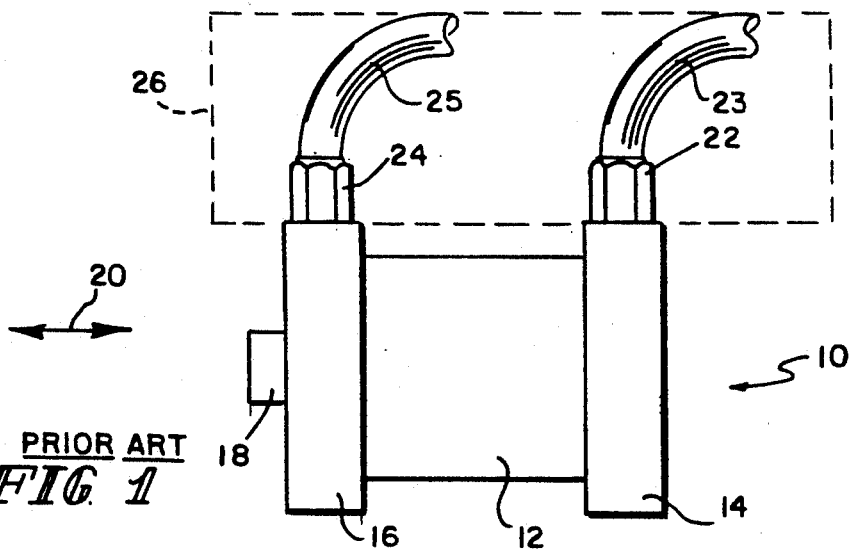
PRIOR ART FIG. 1
FIG. 1 is side elevational view of a conventional double-acting pneumatic cylinder in which air fittings are coupled to ports formed in both ends of the pneumatic cylinder.

Referring now to the drawings, FIG. 1 illustrates a conventional pneumatic cylinder 10 including a cylinder tube 12, and end cap 14, and a head cap 16. A piston located inside cylinder tube 12 moves back and forth within cylinder tube 12 to move piston rod 18 back and forth in the direction of double-headed arrow 20. Cylinder 10 is a conventional double-acting cylinder. A first fitting 22 is coupled to a port formed in end cap 14, and a second fitting 24 is coupled to a port formed in head cap 16. Air pressure is alternately supplied through a tube 23 and fitting 22 and through a tube 25 and fitting 24 to move the piston back and forth within cylinder tube 12. Because the fittings 22 and 24 are coupled to ports in the both head cap 16 and end cap 14, fittings 22 and 24 and tubes 23 and 25 increase the overall envelope size of the cylinder 10 by a dimension illustrated by dotted lines 26 in FIG. 1. This makes it difficult, or impossible, to install the conventional cylinder 10 into a tight mounting configuration.

Figure 2:
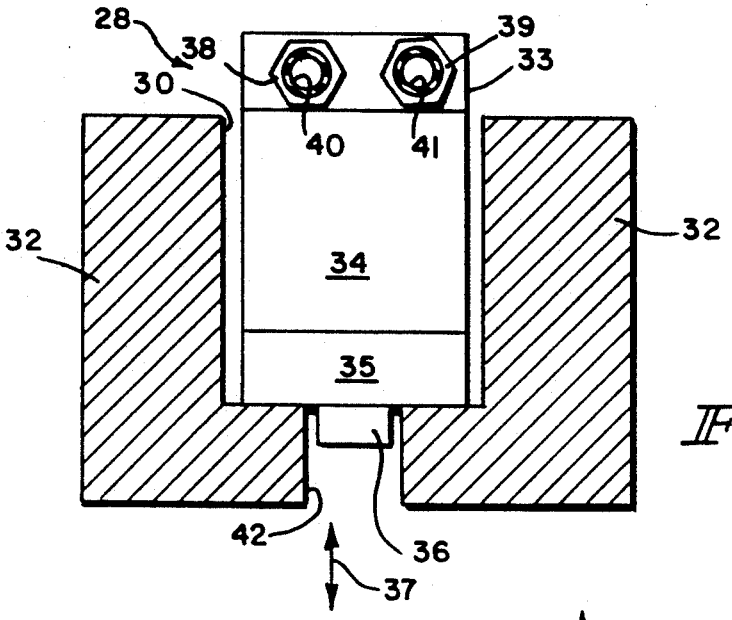
FIG. 2 is a sectional view illustrating a pneumatic cylinder of the present invention in which the two air fittings are coupled to ports formed in an end cap of the cylinder.

FIG. 2 illustrates a pneumatic cylinder 28 of the present invention positioned within a bore 30 formed in a support 32. The cylinder 28 of the present invention includes an end cap 33, a cylinder tube 34, and a head cap 35. A piston (not shown in FIG. 2) moves back and forth within cylinder tube 34 to move a piston rod 36 back and forth in the direction of double-headed arrow 37. In the embodiment illustrated in FIG. 2, two control fittings 38 and 39 are coupled to two ports formed in a side surface of end cap 33 to control movement of the piston. Air supply tubes 40 and 41 are connected to fittings 38 and 39, respectively. Air supplied through tubes 40 and 41 and fittings 38 and 39 as discussed below in detail moves the piston and piston rod 36 through an aperture 42 formed in support 32 in the directions of double-headed arrow 37.

Figure 3:
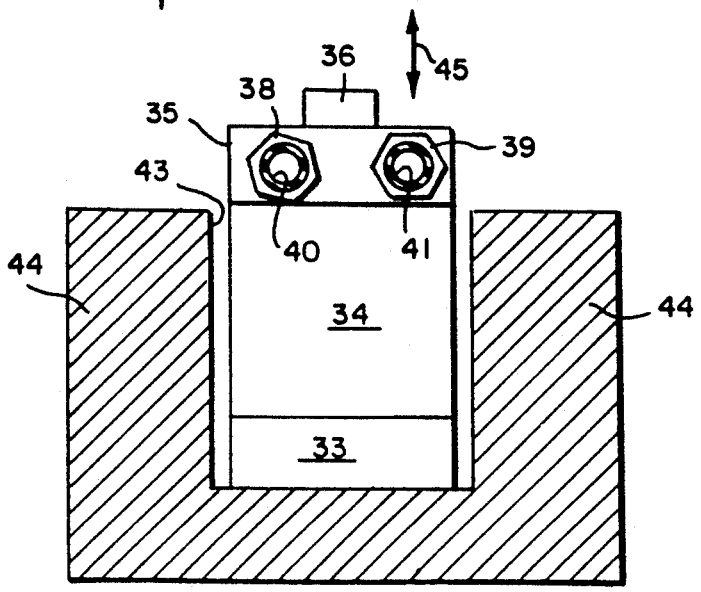
FIG. 3 is a sectional view illustrating the pneumatic cylinder of the present invention in which the two air fittings are coupled to ports formed in a head cap of the cylinder.

In the FIG. 3 embodiment, the cylinder 28 of the present invention is mounted within a blind hole 43 of a support 44. Two fittings 38 and 39 are coupled to two ports formed in a side surface of head cap 35 of cylinder 28. Air supply tubes 40 and 41 are coupled to fittings 38 and 39, respectively, to supply air pressure to the cylinder 28 to move the piston and piston rod 36 back and forth in the directions of double-headed arrow 45. The ports can be selectively formed on five different surfaces of the end cap 33 or head cap 35.

Figures 4, 5:
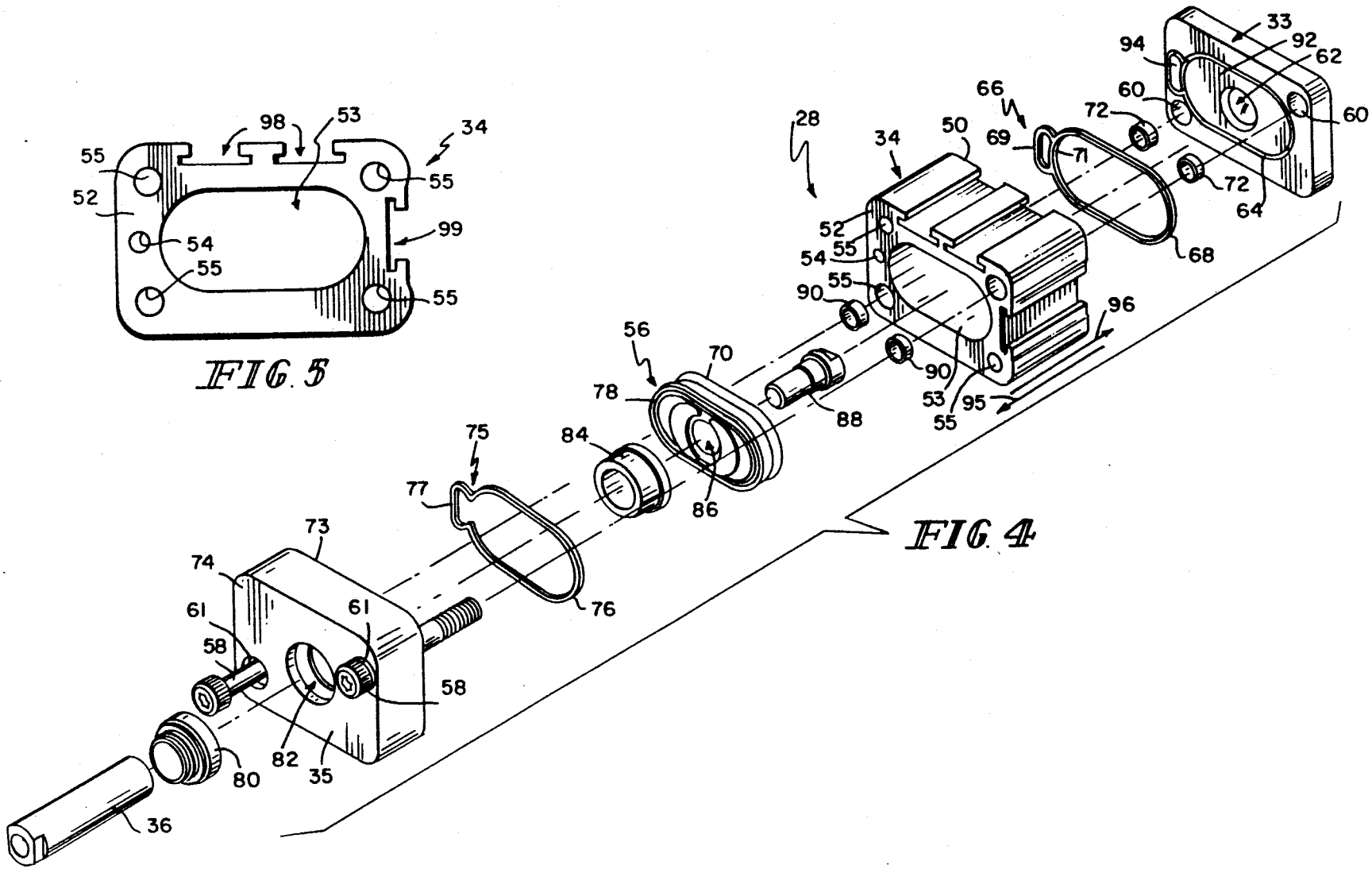
FIG. 4 is an exploded perspective view illustrating one embodiment of the pneumatic cylinder of the present invention.
FIG. 5 is an end elevational view of one embodiment of the cylinder tube of the present invention including a central bore for receiving a piston therein and a second air supply bore formed through the tube which permits air to pass through the second bore in the tube to control movement of the piston.

FIG. 4 is an exploded perspective view illustrating the components of the cylinder apparatus 28 illustrated in FIGS. 2 and 3. Cylinder tube 34 includes a first end 50 and a second end 52. Cylinder tube 34 is formed to include a central bore 53, an extruded second bore 54, and four apertures 55 located at the four corners of tube 34. The central bore 53 is oval-shaped and is configured to receive an oval-shaped piston 56 therein. Apertures 55 permit threaded fasteners 58 to pass through tube 34 as discussed below to secure cylinder 28 together.

End cap 33 is illustratively a steel end cap formed in a conventional manner from FX2008 powdered metal material. End cap 33 includes threaded apertures 60, a central recessed section 62, and a machined groove 64. Aluminum pilot rings 72 are situated between apertures 55 of tube 34 and apertures 60 of end cap 33 to prevent misalignment of tube 34 and end cap 33 during tightening of fasteners 58. Machined groove 64 has a shape identical to the shape of an O-ring seal 66. Seal 66 includes a first generally oval-shaped section 68, and a second, smaller oval-shaped section 69 coupled to one end of the first oval-shaped section 68. Seal 66 is configured to be positioned inside groove 64 formed in end cap 33. Seal 66 is configured to abut first end wall 50 of cylinder tube 34 to provide two sealed chambers between end cap 33 and tube 34 at first end 50 of tube 34. The first chamber is defined between a first seal 70 of piston 56 and end cap 33 within the first oval-shaped section 68 of seal 66. A second chamber is defined by the smaller section 69 of seal 66 and end cap 33 around the extruded bore 54 formed in tube 34. A divider section 71 of seal 66 prevents air flow between the first chamber defined by section 68 and the second chamber defined by section 69.

Head cap 35 includes a first end 73 and a second end 74. A second seal 75 is positioned within a groove 105 (FIG. 7) formed in first end 73 of head cap 35. Second seal 75 has an outer shape identical to the shape of first seal 66. However, the divider portion 71 has been removed from seal 75 so that air can communicate between a first section 76 and a second section 77 of seal 75. Therefore, air can pass through the extruded second bore 54 of tube 34 into the region defined by section 77 of seal 75 and into the region of central bore 53 between section 76 of seal 75 and a second seal 78 of piston 56. Piston 56 reciprocates back and forth inside central bore 53 of tube 34. Piston rod 36 extends through a rod seal 80, through an aperture 82 formed in head cap 35, through a rod bushing 84, through an aperture 86 formed in piston 56, and is threadably coupled to a piston stud 88. Pilot rings 90 are situated between apertures 61 formed in head cap 35 and apertures 55 of tube 34 to prevent misalignment of tube 34 and head cap 35 during tightening of fasteners 58. Pilot rings 90 maintain concentric alignment between central bore 53 of tube 34 and aperture 82 formed in head cap 35 which receives piston rod 36. It is understood that other alignment techniques besides pilot rings 72 and 90 may be used to maintain alignment between end cap 33, cylinder tube 34, and head cap 35.

In the FIG. 4 embodiment, no ports are illustrated. As discussed below in detail, ports can be selectively formed in either end cap 33 or head cap 35 to move piston 56 back and forth within tube 34 depending upon specifications required for the cylinder apparatus 28. In the embodiment illustrated in FIG. 4, ports 100 and 101 (see FIG. 6) may be formed in a first region 92 and a second region 94, respectively, of end cap 33 to provide a means for supplying compressed air to move piston 56 back and forth in the direction of arrows 95 and 96. If it is desired to form the ports in head cap 35 instead of end cap 33, seal 66 is interchanged with seal 75 as discussed below.

FIG. 5 is side elevational view further illustrating the configuration of cylinder tube 34. Cylinder tube 34 is preferably made from extruded aluminum. Tube 34 is formed to include first and second mounting tracks 98 for coupling the tube 34 to a support. In addition, tube 34 is formed to include an optional switch groove 99 for mounting a detector or sensor on tube 34 to monitor the position of piston rod 36. Mounting tracks 98 and switch groove 99 are optional and may be omitted from tube 34 for certain applications.

Figure 6:
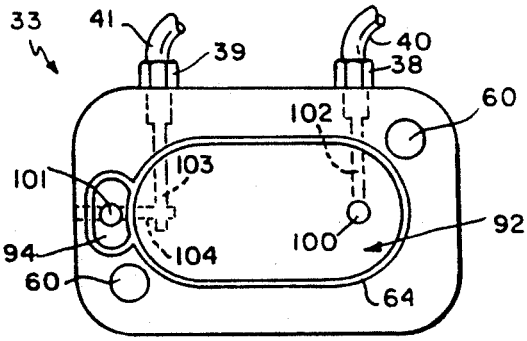
FIG. 6 is a side elevational view of an end cap for use in the first embodiment of the present invention.
Figure 7:
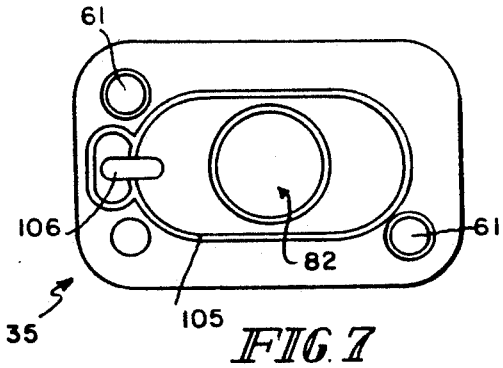
FIG. 7 is a side elevational view of a head cap for use in the first embodiment of the present invention.

FIGS. 6 and 7 further illustrate end cap 33 and head cap 35 of the first embodiment of the present invention shown in FIG. 4. As illustrated in FIG. 6, ports 100 and 101 are formed in first region 92 and second region 94, respectively, of end cap 33. Ports 100 and 101 are connected to first and second fittings 38 and 39 and air supply tubes 40 and 41, respectively. A bore 102 connects fitting 38 to port 100. Bores 103 and 104 intersect to connect fitting 39 to port 101. An end of bore 104 is plugged to prevent air from escaping.

Head cap 35 is preferably made from extruded aluminum. Head cap 35 is formed to include a groove 105 for receiving seal 75 therein. A notched section 106 may be formed in head cap 35 if needed to permit an increased amount of air to pass from bore 54 of tube 34 through notched section 106 and into the region within central bore 53 defined by seal 75 and seal 78 of piston 56 of tube 34. To extend piston rod 36 in the direction of arrow 95, air pressure is supplied to port 100 of end cap 33 to supply air pressure to a first region defined in central bore 53 between first section 68 of seal 66 and seal 70 of piston 56. Air is exhausted from the opposite side of piston 56 through notched section 106, through bore 54 in tube 34, and through port 101 formed in end cap 33.

To move piston 56 toward end cap 33 in the direction of arrow 96, air pressure is supplied through port 101 and passes through bore 54 of tube 34, through notched section 106, and into the region within central bore 53 between seal 75 on head cap 35 and seal 78 of piston 56. This air pressure forces piston 56 to move in the direction of arrow 96 in FIG. 4. Air inside central bore 53 between seal 70 of piston 5 and first section 68 of seal 66 is exhausted through port 100.

Figure 8:
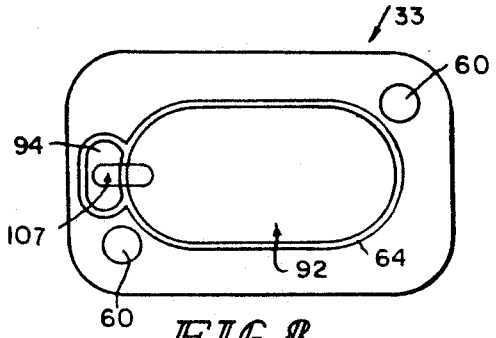
FIG. 8 is a side elevational view of an end cap for use in a second embodiment of the present invention.
Figure 9:
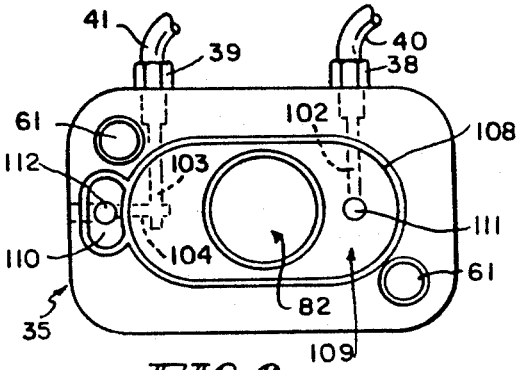
FIG. 9 is a side elevational view of a head cap for use in a second embodiment of the present invention.

If it is necessary or desired to form the air supply ports in head cap 35 of cylinder apparatus 28 to facilitate mounting of cylinder apparatus 28, the second embodiment of the invention illustrated in FIGS. 8 and 9 is used. In this embodiment, a notched section 107 may be formed between regions 92 and 94 of end cap 33. This permits increased air flow from central bore 53 of tube 34 to bore 54 of tube 34 between the first region 92 and the second region 94 of end cap 33. A seal having the shape of seal 75 in FIG. 4 is placed in groove 64 formed in end cap 33.

As illustrated in FIG. 9, a groove 108 is formed in head cap 35 for receiving a seal having the configuration of seal 66 in FIG. 4. This defines first and second separate sealed sections 109 and 110 on head cap 35. Air can not pass back and forth between first and second sealed sections 109 and 110. A first port 111 is formed in head cap 35 in communication with the first region 109. A second port 112 is formed in head cap 35 in communication with second region 110. Ports 111 and 112 are connected to first and second fittings 38 and 39 and air supply tubes 40 and 41, respectively. A bore 102 connects fitting 38 to port 111. Bores 103 and 104 intersect to connect fitting 39 to port 112. An end of bore 104 is plugged to prevent air from escaping.

To move piston 56 within central bore 53 of tube 34 in a direction away from head cap 35, air pressure is supplied to the first port 111. Air is exhausted from the region within the central bore 53 defined by first seal 70 of piston 56 and by the seal located in groove 64 of end cap 33. Air from this region passes through notched section 107, through bore 54 in tube 34, and exits through port 112 formed in head cap 35 which is coupled to an exhaust.

If it is desired to move piston 56 in a direction toward head cap 35, air pressure is supplied to port 112. Air passes through bore 54, through notched section 107, and into the region within central bore 53 defined between the seal located in groove 64 formed in end cap 33 and first seal 70 of piston 56 to force piston 56 toward head cap 35. Air from the region within central bore 53 defined by seal 78 of piston 56 and the sealed section 109 formed by the seal located in groove 108 of head cap 35 is exhausted through port 111.

Additional embodiments of the present invention are illustrated in FIGS. 10–18. In the embodiments of the invention illustrated in FIGS. 10–18, those elements numbered identically with the embodiments illustrated in FIGS. 1–9 perform the same or similar functions. End cap 33, cylinder tube 34, and head cap 35 have similar configurations in each embodiment of the invention. Therefore, the semi-finished parts of the present invention have substantially identical configurations, regardless of the specific embodiment selected for a particular use. Ports and fittings can be selectively added to the semi-finished parts to customize each finished cylinder for use in a particular environment.

Figure 10:
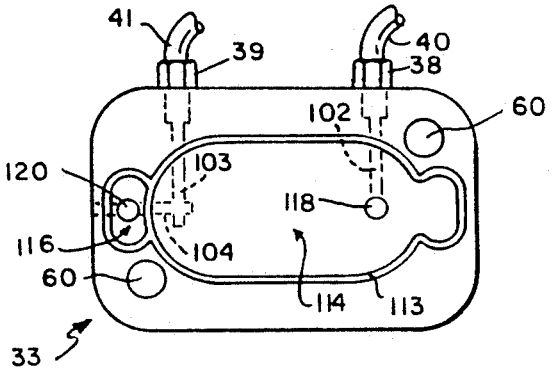
FIG. 10 is a side elevational view of an end cap for use in a third embodiment of the present invention.

End cap 33 illustrated in FIG. 10 is formed to include a groove 113 for receiving a seal therein to define first and second separate sealed regions 114 and 116 against end cap 33. End cap 33 is formed to include a first port 118 in communication with first sealed region 114 and a second port 120 in communication with a second sealed region 116. Ports 118 and 120 are connected to first and second fittings 38 and 39 and air supply tubes 40 and 41, respectively A bore 102 connects fitting 38 to port 118. Bores 103 and 104 intersect to connect fitting 39 to port 120. An end of bore 104 is plugged to prevent air from escaping.

Figure 11:
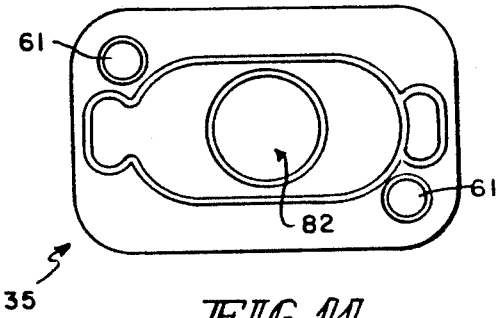
FIG. 11 is a side elevational view of a head cap for use in the third embodiment of the present invention.

Head cap 35 is formed to include a groove 122 therein as illustrated in FIG. 11. Groove 122 is formed to receive a seal having a shape identical to the seal received in groove 113 of end cap 33. This defines a first sealed region 124 and a second sealed region 126 against head cap 35. First sealed region 124 is in communication with both central bore 53 and bore 54 formed in cylinder tube 34.

To move piston 56 within cylinder tube 34 in a direction away from end cap 33 of FIG. 10, air pressure is supplied to port 118. Air is exhausted from a region within central bore 53 between seal 78 of piston 56 and sealed region 124 on head cap 35 through bore 54 and is exhausted through port 120.

To move piston 56 in a direction toward end cap 33, air pressure is supplied to port 120. Air flows through bore 54 and into the region of central bore 53 of tube 34 between first sealed region 124 and seal 78 of piston 56. Air is exhausted from the region inside central bore 53 of tube 34 between seal 70 of piston 56 and first sealed region 114 of end cap 33 through port 118. Advantageously, the embodiment illustrated in FIGS. 10 and 11 uses two seals having identical shapes. The seals are simply reversed depending upon whether the seal is used adjacent end cap 33 or adjacent head cap 35.

Figure 12:
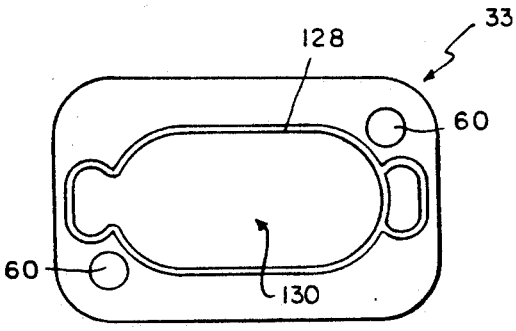
FIG. 12 is a side elevational view of an end cap for use in a fourth embodiment of the present invention.
Figure 13:
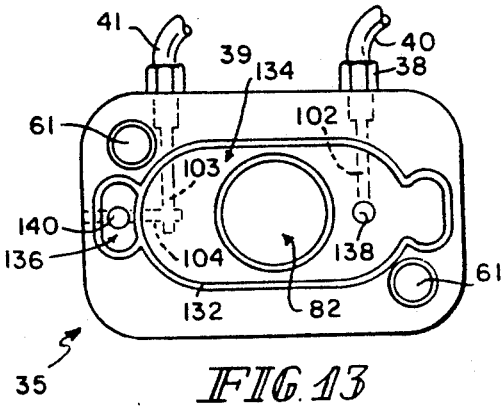
FIG. 13 is a side elevational view of a head cap for use in the fourth embodiment of the present invention.

A fourth embodiment of the present invention is illustrated in FIGS. 12 and 13. If it is desired to provide the ports in head cap 35, then end cap 33 is formed to include a groove 128 for receiving a seal therein to define a relatively large first sealed region 130 which is communication with both bore 54 and with central bore 53 of the cylinder tube 34 as illustrated in FIG. 12. As illustrated in FIG. 13, head cap 35 is formed to include a groove 132 which receives a seal to define a first sealed region 134 in communication with central bore 53 of tube 34 and a second sealed region 136 in communication with bore 54 of tube 34. A first port 138 is formed in head cap 35 in communication with first sealed region 134, and a second port 140 is formed in head cap 35 in communication with second sealed region 136. Ports 138 and 140 are connected to first and second fittings 38 and 39 and air supply tubes 40 and 41, respectively. A bore 102 connects fitting 38 to port 138. Bores 103 and 104 intersect to connect fitting 39 to port 140. An end of bore 104 is plugged to prevent air from escaping.

To move piston 56 in a direction away from head cap 35, air pressure is supplied to first port 138. Air is exhausted from the region inside central bore 53 of tube 34 between seal 70 of piston 56 and sealed region 130 of end plate 33, through bore 54 formed in cylinder tube 34, and through port 140.

To move piston 56 in a direction toward head cap 35, air pressure is supplied to port 140. Air pressure passes through bore 54 of tube 34 and into the region of central bore 53 located between first sealed region 130 of end cap 33 and seal 70 of piston 56. Air from the region of central bore 53 between seal 78 of piston 56 and the first sealed region 134 defined by the seal on head cap 35 is exhausted through port 138.

Figure 14:
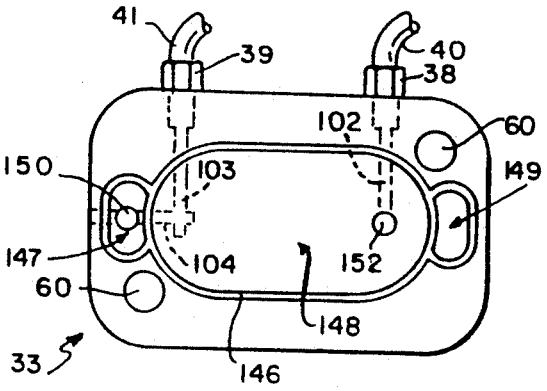
FIG. 14 is a side elevational view of an end cap for use in a fifth embodiment of the present invention.
Figure 15:
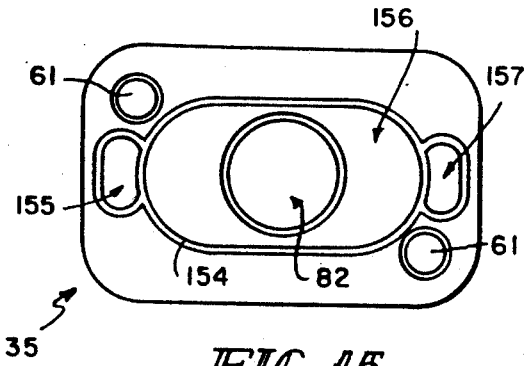
FIG. 15 is a side elevational view of a head cap for use in the fifth embodiment of the present invention.
Figure 18:
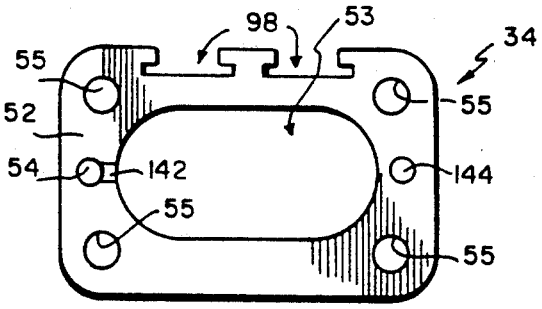
FIG. 18 is a side elevational view of a cylinder tube which includes a central bore for receiving the piston therein, a second bore formed in the tube adjacent the central bore, and a notched section to provide communication between the central bore and the second bore at one end of the tube.

A fifth embodiment of the present invention is illustrated in FIGS. 14 and 15. The configuration of end cap 33 is illustrated in FIG. 14. The configuration of cylinder tube 34 for use in the fifth embodiment of the present invention is illustrated in FIG. 18. The configuration of head cap 35 for use in the fifth embodiment of the invention is illustrated in FIG. 15.

As illustrated in FIG. 18, cylinder tube 34 is formed to include a notched section 142 adjacent to the second end 52 of tube 34. Notched section 142 provides communication between central bore 53 of cylinder tube 34 and bore 54. Cylinder tube 34 is also formed to include a bore 144 extending between the first and second sides 52 and 54 of tube 34. Bore 144 is located on an opposite side of central bore 53 from bore 54. Bore 144 may be used in combination with a third port (not shown) formed in end cap 33 or head cap 35 to increase air flow through the cylinder tube 34 during movement of piston 56. In addition, bore 144 permits the end cap or head cap to be rotated 180 degrees relative to the cylinder tube 34 so that a port is aligned with bore 144 to contol movement of piston 56. In this instance, a notched section such as notched section 142 is formed between central bore 53 and bore 144.

End cap 33 illustrated in FIG. 14 is formed to include a groove 146 therein for receiving a symmetrical seal therein to define sealed regions 147, 148, and 149 against end cap 33. Sealed region 147 is located adjacent bore 54 of cylinder tube 34 at first end 50 of cylinder tube 34. Sealed region 148 is located adjacent central bore 53 at the first end 50 of tube 34. Sealed region 149 is located adjacent bore 144. End cap 33 is formed to include a first port 150 in communication with first sealed region 147 and a second port 152 in communication with second sealed region 148. Ports 152 and 150 are connected to first and second fittings 38 and 39 and air supply tubes 40 and 41, respectively. A bore 102 connects fitting 38 to port 152. Bores 103 and 104 intersect to connect fitting 39 to port 150. An end of bore 104 is plugged to prevent air from escaping.

As illustrated in FIG. 15, head cap 35 is formed to include a groove 154 for receiving a seal therein. The seal located in groove 154 has a shape identical to the seal located in groove 146 of end cap 33. The seal in groove 154 defines three separate sealed regions 155, 156 and 157 against head cap 35.

To move piston 56 inside tube 34 in a direction toward end cap 33, air pressure is supplied to port 150. Air pressure passes through port 150 and into bore 54 of cylinder tube 34. Air pressure passes through notched section 142 of tube 34 and into the region of central bore 53 of tube 34 defined between seal 78 of piston 56 and the second sealed region 156 of head cap 35. Air from the region of central bore 53 defined between seal 70 of piston 56 and the second sealed region 148 of end cap 33 is exhausted through port 152.

To move the piston 56 in a direction toward head cap 35, air pressure is supplied to port 152. Therefore, air enters the region of central bore 53 defined between second sealed region 148 of end cap 33 and seal 70 of piston 56. Air is exhausted from the region of central bore 53 defined between seal 78 of piston 56 and the second sealed region 156 of head cap 35 through notched section 142 of cylinder tube 34 and through bore 54. Air is exhausted from bore 54 through port 150.

Figure 16:
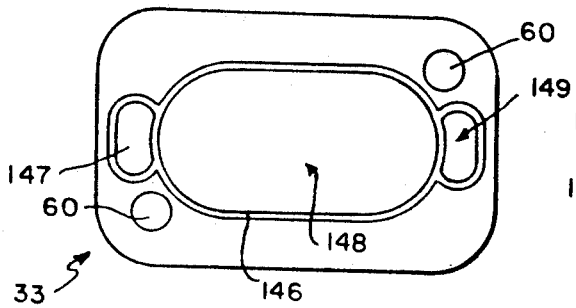
FIG. 16 is a side elevational view of an end cap for use in a sixth embodiment of the present invention.
Figure 17:
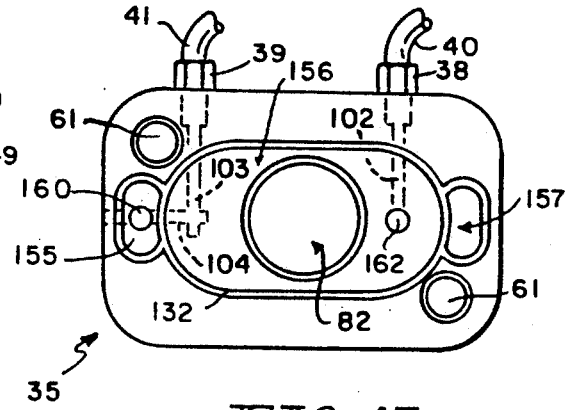
FIG. 17 is a side elevational view of a head cap for use in the sixth embodiment of the present invention.

A sixth embodiment of the present invention is illustrated in FIGS. 16 and 17. As illustrated is FIG. 16, end cap 33 is formed to include the same groove 146 illustrated is FIG. 14. However, ports 150 and 152 are not formed in end cap 33 in the FIG. 16 embodiment. In this embodiment, ports 160 and 162 are formed in head cap 35 illustrated in FIG. 17 in communication with first sealed region 155 and second sealed region 156, respectively. Ports 162 and 160 are connected to first and second fittings 38 and 39 and air supply tubes 40 and 41, respectively. A bore 102 connects fitting 38 to port 162. Bores 103 and 104 intersect to connect fitting 39 to port 160. An end of bore 104 is plugged to prevent air from escaping.

In the sixth embodiment, a notched section is formed in cylinder tube 34 adjacent the first end 50 of cylinder tube 34 instead of against second end 52 as illustrated in FIG. 18. In the sixth embodiment, the notched section permits air flow between central bore 53 and bore 54 of tube 34 adjacent first end 50 of tube.

In order to move the piston 56 in a direction toward head cap 35, air pressure is supplied to port 160. Air pressure passes through bore 54, through the notched section formed adjacent first end 50 of cylinder tube 34 and into the region of central bore 53 defined between seal 70 of piston 56 and sealed region 148 of end cap 33. Air is exhausted from the region of central bore 53 defined between seal 78 of piston 56 and sealed region 156 of head cap 35 through port 162.

In order to move piston 56 toward end cap 33, air pressure is supplied to port 162. Air is exhausted from the region of central bore 53 between seal 70 of piston 56 and sealed region 148 of end plate 33 through the notched section formed adjacent the first end 50 of tube 34 and through bore 54. Air is exhausted from bore 154 through port 160.

From the preceding description of the preferred embodiments, it is evident that the objects of the invention are obtained. Although the invention has been described and illustrated in detail, it is understood that the same is intended by way of illustration and example only, and is not to be taken by way of limitation. The spirit and scope of the invention are to be limited only by the terms of the appended claims.

What is claimed is:

1. A cylinder apparatus comprising:

a piston;

a cylinder tube having a first end and a second end, the cylinder tube being formed to include a central bore extending from the first end to the second end for receiving the piston therein and a second bore extending from the first end to the second end spaced apart from the central bore;

a first end cap coupled to the first end of the tube, the first end cap being formed to include means for communicating air between the central bore and the second bore adjacent the first end of the cylinder tube;

a second end cap coupled to the second end of the tube, the second end cap being formed to include a first port in communication with the central bore of the tube and a second port in communication with the second bore; and first and second seals disposed, respectively, between the first end cap and the first end of the tube and the second end cap and the second end of the tube, each of said seals having an outer perimeter of substantially identical size and shape.

2. The apparatus of claim 1, wherein the means for communicating air between the central bore and the second bore adjacent the first end of the cylinder tube includes a notched section formed in the first end cap to permit air flow through the notched section from the central bore to the second bore.

3. The apparatus of claim 1, wherein the first seal permits air to pass between the central bore and the second bore adjacent the first end of the cylinder tube.

4. The apparatus of claim 3, wherein the first end cap is formed to include a groove therein for receiving the first seal.

5. The apparatus of claim 3, wherein the second seal blocks air flow between the central bore and the second bore of the cylinder tube adjacent the second end of the cylinder tube.

6. The apparatus of claim 5, wherein the second seal includes a first section in communication with the central bore, a second section coupled to the first section in communication with the second bore, and a divider located between the first section and the second section to block air flow between the first and second sections.

7. The apparatus of claim 5, wherein the second end cap is formed to include a groove therein for receiving the second seal.

8. The apparatus of claim 1, further comprising means for selectively coupling the first port to a pressure supply and the second port to an exhaust to move the piston in a first direction within the cylinder tube, and for selectively coupling the second port to the pressure supply and the first port to the exhaust to move the piston in a second direction within the cylinder tube.

9. The apparatus of claim 1, further comprising a notched section formed in the first end of the cylinder tube between the central bore and the second bore of the cylinder tube to permit air flow from the central bore to the second bore of the cylinder tube adjacent the first end of the cylinder tube.

10. A cylinder apparatus comprising:

a piston;

a cylinder tube including a first end and a second end, the cylinder tube being formed to include a central bore extending from the first end to the second end for receiving the piston therein and a second bore extending from the first end to the second end spaced apart from the central bore;

a first end cap coupled to the first end of the tube;

a second end cap coupled to the second end of the tube, the second end cap being formed to include a first port in communication with the central bore of the tube and a second port in communication with the second bore;

means for selectively coupling the first port to a pressure supply and the second port to an exhaust to move the piston in a first direction within the cylinder tube and for selectively coupling the second port to the pressure supply and the first port to the exhaust to move the piston in a second direction within the cylinder tube;

a first seal location between the first end cap and the first end of the cylinder tube, the first seal permitting air blow between the central bore and the second bore adjacent the first end of the cylinder tube; and a second seal located between the second end cap and the second end of the cylinder tube, the second seal being configured to block air flow between the central bore and the second bore of the cylinder tube adjacent the second end of the cylinder tube;

wherein said first and second seals have outer perimeters of substantially identical size and shape.

11. The apparatus of claim 10, wherein the second seal includes a first section in communication with the central bore, a second section coupled to the first section in communication with the second bore, and a divider located between the first section and the second section to block air flow between the first and second sections.

12. The apparatus of claim 10, wherein the first end cap is formed to include a groove therein for receiving the first seal.

13. The apparatus of claim 12, wherein the second end cap is formed to include a groove therein for receiving the second seal.

14. The apparatus of claim 10, further comprising a notched section formed in the first end cap to increase air flow from the central bore to the second bore of the cylinder tube adjacent the first end of the cylinder tube.

15. The apparatus of claim 13, wherein the first seal includes a first section in communication with the central bore, a second section coupled to the first section in communication with the second bore, and a divider located between the first section and the second section.

16. The apparatus of claim 10, further comprising a notched section formed in the first end of the cylinder tube between the central bore and the second bore of the cylinder tube to permit air flow from the central bore to the second bore of the cylinder tube adjacent the first end of the cylinder tube.

17. A cylinder apparatus comprising:

a piston;

a piston rod coupled to the piston;

a cylinder tube including a first end and a second end, the cylinder tube being formed to include a central bore extending from the first end to the second end for receiving the piston therein and a second bore extending from the first end to the second end spaced apart from the central bore;

an end cap coupled to the first end of the tube;

a head cap coupled to the second end of the tube, said head and end caps being symmetrically formed and substantially similar in size and shape, the head cap being formed to include an aperture therein configured to receive the piston rod therethrough;

means for moving the piston back and forth inside the central bore of the cylinder tube, the moving means including a first port in communication with the central bore of the tube and a second port in communication with the second bore, the first and second ports being formed selectively in one of the end cap and the head cap, the moving means also including means for selectively coupling the first port to a pressure supply and the second port to an exhaust to move the piston in a first direction within the cylinder tube and for selectively coupling the second port to the pressure supply and the first port to the exhaust to move the piston in a second direction within the cylinder tube.

18. The apparatus of claim 17, further comprising a first seal selectively located between the end cap and the first end of the cylinder tube or between the head cap and the second end of the cylinder tube at an end of the cylinder tube opposite from the first and second ports, the first seal permitting air to pass between the central bore and the second bore.

19. The apparatus of claim 18, further comprising a second seal located at an end of the cylinder tube opposite from the first seal, the second seal blocking air flow between the central bore and the second bore of the cylinder tube.

20. The apparatus of claim 19, wherein the end cap is formed to include a groove therein for receiving one of said first and second seals, and the head cap is formed to include a groove therein for receiving the other of said seals.

21. The apparatus of claim 20, wherein the first and second seals have a substantially identical shapes.

22. The apparatus of claim 19, wherein the second seal includes a first section in communication with the central bore, a second section coupled to the first section in communication with the second bore, and a divider located between the first section and the second section to block air flow between the first and second sections.

23. The apparatus of claim 17, further comprising a notched section selectively formed in the end cap or the head cap opposite from the first and second ports to increase air flow from the central bore to the second bore of the cylinder tube adjacent the end of the cylinder tube opposite from the first and second ports.

24. The apparatus of claim 17, further comprising a notched section formed between the central bore and the second bore of the cylinder tube at an end of the cylinder tube opposite from the first and second ports to permit air flow from the central bore to the second bore of the cylinder tube.

* * * * *